United States Patent [19]

Kühn et al.

[11] Patent Number: 4,479,550

[45] Date of Patent: Oct. 30, 1984

[54] SUBMERGING RAMMING ARRANGEMENT

[75] Inventors: Hans Kühn, Hamburg; Jochen Rüsen, Ellerau, both of Fed. Rep. of Germany

[73] Assignee: Koehring GmbH, Hamburg, Fed. Rep. of Germany

[21] Appl. No.: 330,769

[22] Filed: Dec. 14, 1981

[30] Foreign Application Priority Data

Dec. 16, 1980 [DE] Fed. Rep. of Germany ..... 3047375

[51] Int. Cl.[3] ..... B23B 45/16; B23Q 5/027

[52] U.S. Cl. ..... 173/112; 173/148; 173/19; 173/83; 173/DIG. 1

[58] Field of Search ..... 173/148, DIG. 1, 112, 173/149, 150, 19, 83, 131; 175/6

[56] References Cited

U.S. PATENT DOCUMENTS

| | | | |
|---|---|---|---|
| 2,689,547 | 9/1954 | Pearson | 173/112 |
| 3,141,509 | 7/1964 | Bent | 173/19 |
| 4,043,405 | 8/1977 | Kuhn | 173/DIG. 1 X |
| 4,075,858 | 2/1978 | Frederick | 173/DIG. 1 X |

FOREIGN PATENT DOCUMENTS

| | | | |
|---|---|---|---|
| 389486 | 3/1933 | United Kingdom | 173/119 |

*Primary Examiner*—E. R. Kazenske
*Assistant Examiner*—Willmon Fridie, Jr.
*Attorney, Agent, or Firm*—Michael J. Striker

[57] ABSTRACT

A submerging ramming arrangement has a housing, an impacting body axially displaceable in the housing for delivering ramming impacts against a ramming pile, a hydraulic drive for displacing the impacting body in the housing, a hydraulic cylinder-and-piston unit arranged in an upper portion of the housing and having a cylinder, a piston sealingly displaceable in the cylinder and subdividing the same into first and second chambers, a piston rod connected with the piston and having a portion extending from the first chamber coaxially outwardly beyond the cylinder, a holding element for mounting the arrangement on a supporting element and provided on the outwardly extending portion of the piston, a hydraulic accumulator communicating with the first chamber of the cylinder-and-piston unit and arranged for receiving excess hydraulic medium under pressure, and an indicating element actuated by the piston of the cylinder-and-piston unit within a predetermined distance from a respective end of the cylinder-and-piston unit.

29 Claims, 8 Drawing Figures

SUBMERGING RAMMING ARRANGEMENT

BACKGROUND OF THE INVENTION

The present invention relates to a submerging ramming arrangement with a housing, an impacting body for delivering ramming impacts, pressure medium actuating drive means for the impacting body, and holding means for suspending the arrangement on a supporting element.

Ramming arrangements of this general type are known in the art. Known ramming arrangements are disclosed, for example, in the German Offenlegungsschrift Nos. 2,454,521 and 2,538,642. The housing of these known arrangements is suspended on a supporting cable which extends from a suitable lifting mechanism, for example a crane, to supporting brackets or ears arranged fixedly on the housing. Since the impacting body of the ramming arrangement during each ramming stroke delivers impact against the ramming pile or a cap arranged thereon and drives the pile by a respective amount further into the bottom, the ramming arrangement during the ramming operation must be lowered in correspondence with the obtained driving in, because otherwise the ramming impact is no longer transmitted to the ramming part but instead acts upon the housing or the supporting element in damaging manner. In the event of ramming operation from a floating base, the latter is subjected to the action of sea waves and other external influences producing irregular movements which are increased in these conditions because of the boom of the lifting mechanism. The displacement of the ramming arrangement suspended on the supporting cables, which takes place in vertical direction, makes it necessary to continuously monitor the position of the ramming arrangement so as to guarantee that the running ramming arrangement is continuously placed on the ramming pile.

For eliminating the above mentioned difficulties, it has for a long time been known to arrange the ramming arrangement as a whole in a supporting frame which is suspended from the supporting cable, in a vertically displaceable manner, so that it can automatically follow the downward movement of the ramming pile, and the supporting frame provides for a compensation of uncontrollable vertical movements resulting from the sea waves, etc. This construction, however, has the disadvantage that, because of the provision of the supporting frame, the outer dimensions and the entire suspended weight are considerably increased, whereby the handling becomes more difficult and it is also prevented that the ramming device can follow the ramming pile through pile guides corresponding in diameter to that of the pile.

SUMMARY OF THE INVENTION

Accordingly, it is an object of the present invention to provide a submerging ramming arrangement which avoids the disadvantages of the prior art.

More particularly, it is an object of the present invention to provide a ramming arrangement which does not have an undesirable increase of the transverse dimensions and does not require continuous manipulations of the supporting element, and at the same time allows to provide automatic adaptation to the driving progress and all unintentional displacements of the supporting elements within wide limits.

In keeping with these objects and with others which will become apparent hereinafter, one feature of the present invention resides, briefly stated, in a submerging ramming arrangement having a housing, an impacting body displaceable in the housing for delivering ramming impacts, and hydraulic drive means for displacing the impacting body in the housing, wherein a hydraulic cylinder-and-piston unit is provided in an upper portion of the housing and having a cylinder with a longitudinal axis extending in direction of the displacement of the impacting body, a piston sealingly displaceable in the cylinder and subdividing the same into a first chamber further from the impacting body and a second chamber closer to the latter, a piston rod connected with the piston and having a portion extending from the first chamber coaxially outwardly beyond the cylinder, holding means is further provided for mounting the arrangement on a supporting element and arranged on the outwardly extending portion of the piston, a hydraulic accumulator is arranged in communication with the first chamber of the cylinder-and-piston unit for receiving excess hydraulic medium under a negative pressure, and finally indicating means is actuated by the piston of the cylinder-and-piston unit within a predetermined distance from a respective end of the cylinder-and-piston unit.

Since the supporting element or elements are mounted on the holding means connected with the piston rod, the ramming arrangement placed on the ramming pile can follow the latter by the respective displacement of the piston connected with the piston rod in the cylinder in correspondence with the driving progress within a distance limited by the length of the cylinder. On the other hand, unpredictable displacements of a lifting mechanism arranged on a floatable base, and the supporting element suspending therefrom because of sea waves and other external influences are automatically compensated within the distance predetermined by the length of the hydraulic cylinder without influencing the position of the ramming arrangement on the ramming pile. Since the piston rod which carries the piston displaceable in the cylinder can move only upwardly when a respective quantity of the hydraulic fluid available in the upper chamber of the hydraulic cylinder can flow with overcoming of the tension into the hydraulic accumulator connected therewith, it is possible to adjust the tension of the hydraulic accumulator so that in the position of the ramming arrangement seated on the ramming pile, in which the arrangement no longer applies a pulling force to the piston rod, the piston rod is displaced outwardly in the hydraulic cylinder by a pulling force acting upon the supporting element upwardly with overcoming of the opposite resistance of the hydraulic fluid acting upon the upper side of the piston, and return to its initial position with weakening of the pulling force. When to the contrary, the ramming arrangement, during lowering onto the ramming pile or after lifting from the latter, hangs on the piston rod with its weight, optionally reduced by buoyancy, the hydraulic liquid accommodated in the hydraulic cylinder can be so entrapped by actuation of blocking means provided in the connecting conduit to the first or second chamber of the hydraulic cylinder that the piston and the piston rod are fixed relative to the hydraulic cylinder and the piston rod can thereby take up the entire weight of the ramming arrangement without a noticeable displacement of the piston rod relative to the hydraulic cylinder.

When the piston approaches the upper end of the hydraulic cylinder during the ramming operation because of the preceding driving of the ramming pile or because of pulling out of the piston rod as a result of vertical movements due to sea waves and the like, the indicating means is actuated. When in contrast the piston approaches the lower end of the hydraulic cylinder to a predetermined distance during placing of the ramming arrangement onto the ramming pile or during lowering of the supporting element because of other reasons, the respective indicating means is again actuated. The indicating means can be of different constructions and formed, for example, as a plunger displaceable by a pressure medium or as proximity indicators operating electrically, magnetically or pneumatically. The signals from the indicating means can be transmitted by conventional means to a control stand of the ramming device to produce visible or audible signals for the operator, so as to make it possible for him to actuate the lifting mechanism for the supporting element of the piston rod for producing required strokes of lifting or lowering. With respective arrangement of the controlling means it can also be provided that during the ramming operation, the piston rod always, when the piston actuates the upper indicating means, automatically lowers by a predetermined distance, for example half the length of the hydraulic cylinder.

In accordance with a further feature of the present invention, the indicating means cooperates with regulating means actuated thereby for automatic stopping of the drive means of the impacting body. It is thereby guaranteed that the ramming arrangement is reliably prevented from operation prior to lifting from the pile.

In accordance with still another advantageous feature of the present invention, the second chamber of the hydraulic cylinder-and-piston unit is connected via connecting conduit with a pressure medium receiving chamber of the drive means for the impacting body. It is possible to provide at both ends of the cylinder-and-piston unit pushers which are displaceable by the piston and arranged so that during its outward movement control means for the drive means of the impacting body is actuated. At the end of the cylinder-and-piston unit closer to the impacting body, a regulating piston can move in a first regulating cylinder and be provided with a pusher extending into the second chamber by a predetermined distance, wherein the first regulating piston is depressable by the piston connected with the piston rod with overcoming a predetermined counterforce to a position actuating the control means for the drive of the impacting body for stopping same.

In accordance with a further feature of the present invention, the hydraulic cylinder-and-piston unit can be provided at its end facing away from the impacting body with a second regulating piston sealingly displaceable in a second regulating cylinder and provided with a pusher extending in the first chamber by a predetermined distance. The second regulating cylinder is connected at the side facing away from the first chamber with the end portion of the first regulating cylinder facing toward the second chamber, with the aid of a connecting conduit. Thereby the hydraulic fluid which is displaced during depression of the second regulating piston depresses the first regulating piston into a position actuating the control means for the drive of the impacting body for stopping same.

As mentioned before, it is especially advantageous when blocking means is provided in at least one connecting conduit to the chambers of the hydraulic cylinders and actuation of the blocking means provides for closing of hydraulic fluid accommodated in the respective chamber off the cylinder-and-piston unit so that it blocks any displacement of the piston in this direction. The blocking means is formed advantageously as a check valve and can move to their blocking position for blocking the connecting conduits by regulating means associated therewith during drop of the pressure in the pressure medium supply conduit to the drive means of the impacting body.

Still a further feature of the present invention resides in the fact that the driving arrangement in accordance with the invention is formed, for avoiding longer hydraulic conduits, so that the hydraulic accumulator connected with the cylinder-and-piston unit, the pressure medium receiving chamber connected with the other chamber of the cylinder-and-piston unit, and the pressure medium source of the drive means of the impacting body are arranged in or on the housing. Thereby, a very short path for the hydraulic fluid is provided, and a delay-free and reliable response of all functions is guaranteed.

In accordance with still a further feature of the present invention, the hydraulic accumulator communicating with one chamber of the cylinder-and-piston unit is arranged in the housing, whereas the other chamber of the cylinder-and-piston unit is connected via a pressure medium return conduit of the drive means of the impacting body with a pressure medium receiving chamber arranged over water, and normally the pressure medium supply conduit of the drive means of the impacting body communicates with a pressure medium source above water.

In accordance with a simplified embodiment, the cylinder-and-piston unit can be formed as a single-acting cylinder-and-piston unit with permanently open second chamber.

A further improvement of the inventive ramming arrangement resides in the fact that the piston rod displaceable in the cylinder of the cylinder-and-piston unit is tubular and forms a throughgoing inner hollow chamber which can serve for receiving the required feed conduits for hydraulic fluid, pressure gas, electrical energy, control conduits. The piston rod can be provided in its end portion facing toward the impacting body with a closed switch chamber communicating with the inner chamber. This switch chamber can easily be formed water-tight and receives suitable wiring and/or switch means for the individual supply conduits. For preventing locking and intertwisting of the supply conduits or their rotation, guiding means can be provided for total elimination of rotation of the piston rod relative to the hydraulic cylinder.

For adjusting the force counteracting withdrawal of the piston rod from the cylinder, the hydroaccumulator communicating with the first chamber of the cylinder-and-piston unit can have means for adjusting the tension of the hydraulic fluid contained therein.

The novel features which are considered characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
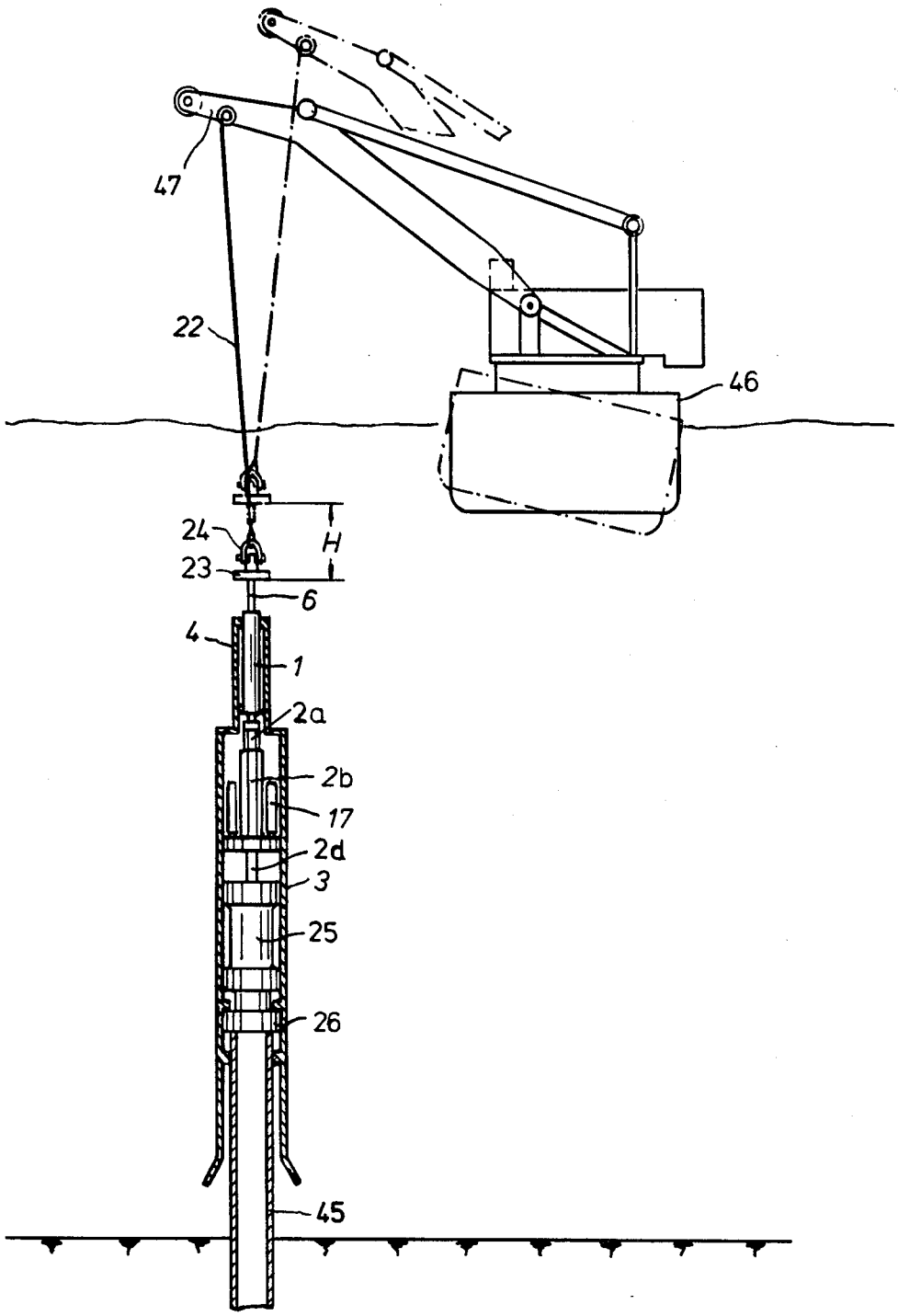
FIG. 1 is a schematic view showing a ramming arrangement placed on a ramming pile under water and suspended on a lifting mechanism of a floating base.

A ramming arrangement shown in FIG. 1 is lowered by a crane 47 of a working ship 46 with the aid of a supporting cable 22 so that it assumes a position in which it is seated on a driven-in ramming pile 45.

The ramming arrangement has a substantially cylindrical housing 3, an impacting body 25 which is displaceable parallel to the longitudinal axis of the housing 3 and is guided by the latter, a hydraulically actuated drive cylinder-and-piston unit 2*a* which moves the impacting body 25 via a piston rod 29 upwardly and downwardly so that during the downwardly directed impact stroke the impacting body delivers an impact against an impacting cap 26 arranged in the shown position on the upper edge of the tubular ramming pile 45. A further hydraulic cylinder-and-piston unit 1 is coaxially arranged in a casing 4 which coaxially projects from the upper end of the housing. The cylinder-and-piston unit 1 has a hydraulic cylinder, and a piston 6*a* is connected with the piston rod 6 and displaces in the cylinder. The upper end of the piston rod 6 extends outwardly beyond the cylinder, and a transverse piece 23 with a bracket 24 for a supporting cable 22 of the crane 47 is arranged on this portion.

When during the progress of the ramming operation the ramming pile 45 is driven increasingly deeper into the sea bottom, the ramming arrangement seated on the upper end of the ramming pile 44 must be correspondingly displaced downwardly so as to prevent its unpredictable lifting from the ramming pile 45, which can lead to direct impacting by the impacting body 25 against the inner flange of the housing 3 located thereinbelow and thereby to heavy damage or breakage of the supporting cable under impacting load.

Since the working ship 45 is subjected under the action of sea waves, wind, etc., to more or less strong vertical and/or compensating movements, of which the latter is further increased by the length of the crane boom, the upper end of the crane boom connected with the supporting cable 22 moves generally periodically by a more or less great distance H upwardly and downwardly, as schematically shown in FIG. 1.

Figure 2:
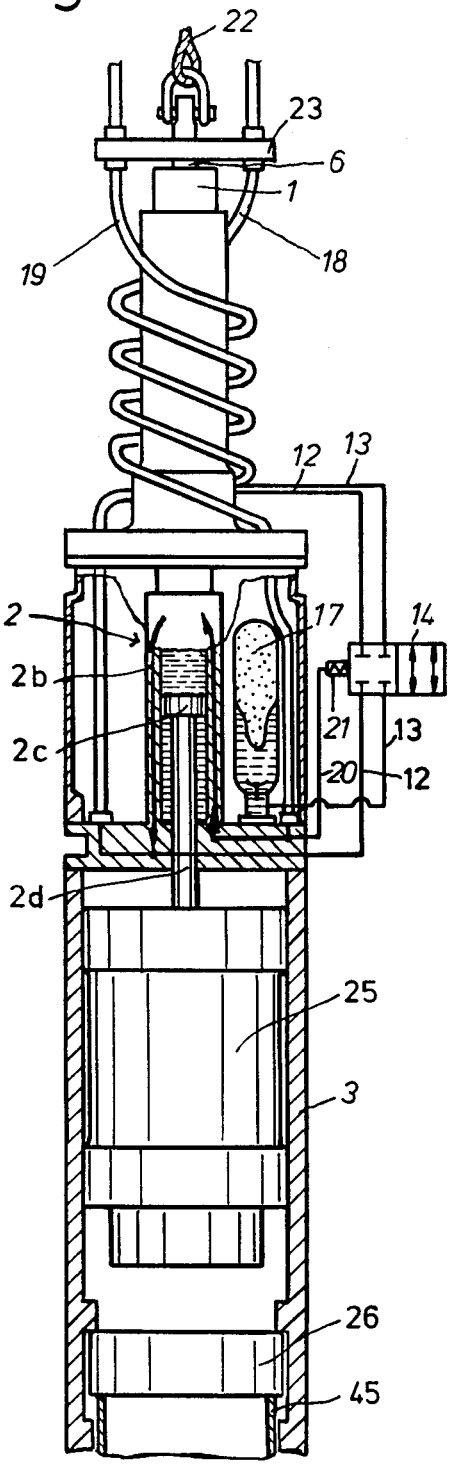
FIG. 2 is an enlarged partially sectioned view of the upper part of the ramming arrangement of FIG. 1.
Figure 3:
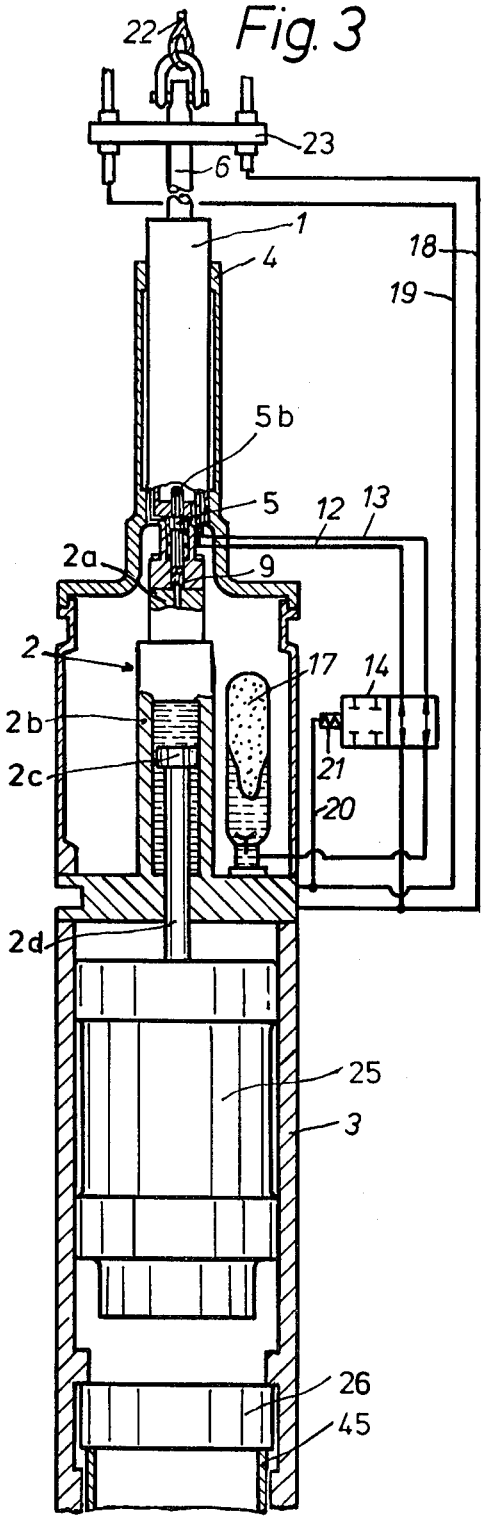
FIG. 3 is an enlarged longitudinal section through the upper part of the ramming arrangement of FIG. 1.

As can be seen from FIGS. 2 and 3, the transverse piece 23 serves for holding a pressure medium supply conduit 19 from a pressure medium source arranged on the working ship, and also a pressure medium return conduit 18 which leads to a pressure medium receiving chamber arranged on board the working ship. The pressure medium supply conduit 19 and the pressure medium return conduit 18 lead to a control device 2*a* whose construction is not shown in detail and is disclosed, for example, in the German Offenlegungsschrift No. 2,900,221. By means of this control device 2*a*, the drive cylinder 2*b* is permanently connected with its annular chamber located below the sealingly displaceable piston 2*c*, with the pressure medium source. At the same time, the chamber located above the piston 2*c* alternately communicates with the pressure medium source or the pressure medium receiving space so that, because of the greater active piston surface at the upper side of the piston 2*c*, alternating upward and downward movements of the piston 2*c*, the piston rod 2*d*, and the impacting body 25 connected therewith are produced. When during the impacting stroke the lower chamber is connected via a connecting conduit with the upper chamber, the hydraulic fluid displaced from the lower chamber can overflow into the upper chamber. Since thereby a considerable part of the quantity of the pressure fluid flowing into the upper chamber during impacting stroke for sufficient downward acceleration of the impacting body flows a short flow path from the lower chamber, operation is possible despite the flow path from the pressure medium source to the drive cylinder 2*b* without excessively great hydraulic pumps.

Figure 4:
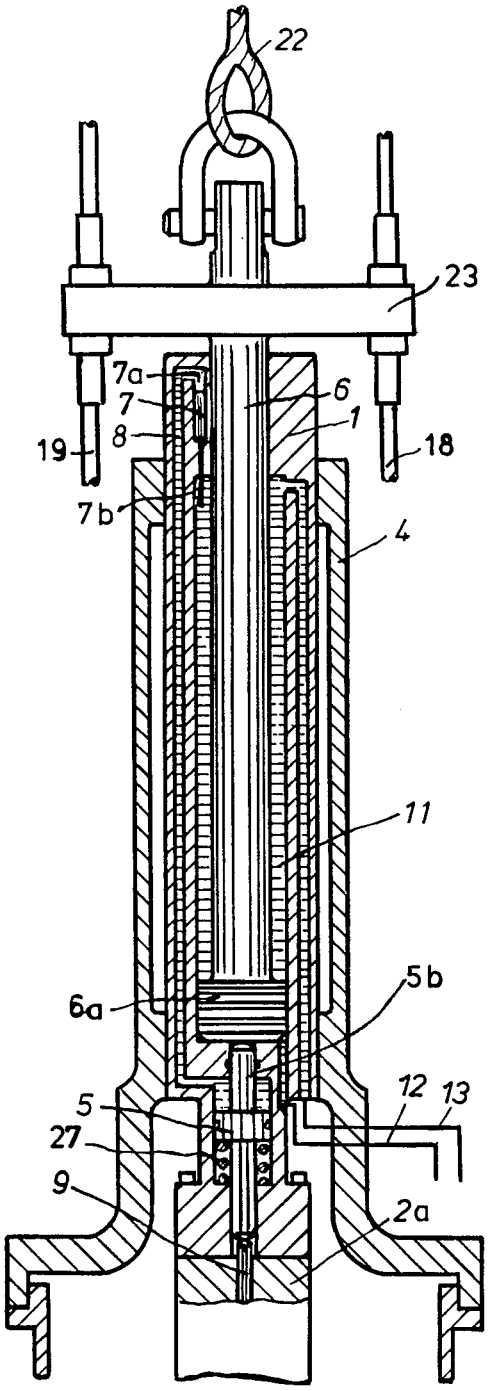
FIG. 4 is a considerably enlarged longitudinal section through a hydraulic cylinder-and-piston unit of the ramming arrangement of FIG. 1 with an inserted piston rod.
Figure 5:
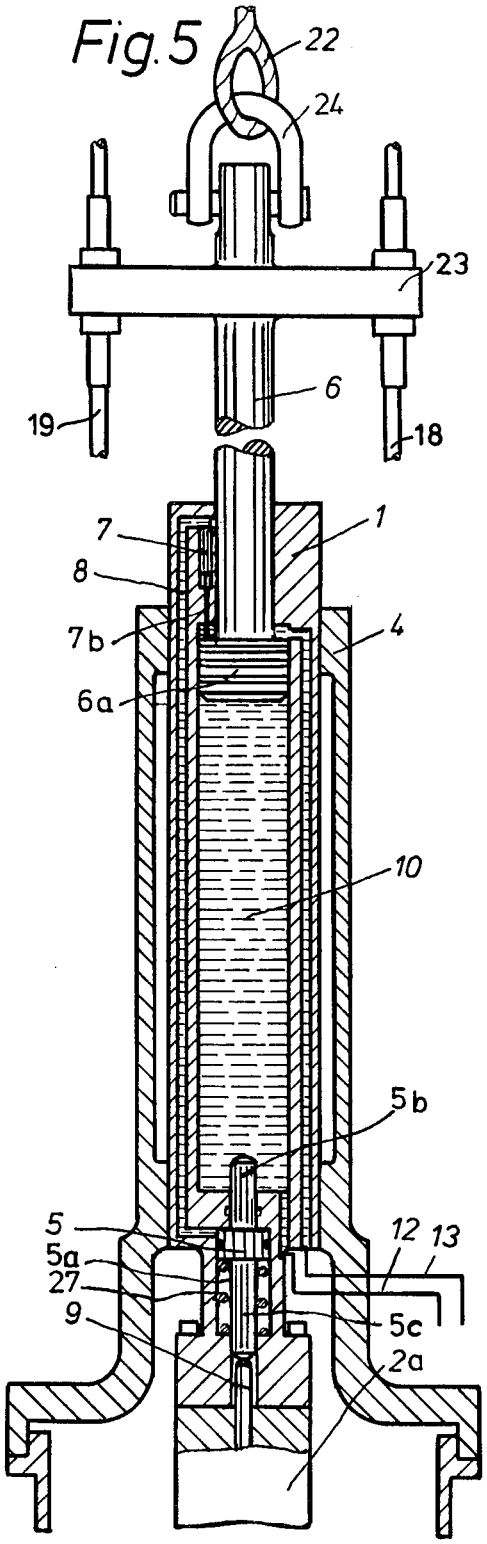
FIG. 5 is a considerably enlarged longitudinal section through the hydraulic cylinder of the ramming arrangement of FIG. 1 with a withdrawn piston rod.

A hydroaccumulator 17 or several hydroaccumulators arranged parallel to one another are provided in the housing 3 near the drive cylinder 2*b*. As can be seen from FIGS. 4 and 5, the hydraulic cylinder-and-piston unit is releasably held in the bending-resistant casing 4, and the piston 6*a* arranged at the lower end of the piston rod 6 subdivides the cylinder into a first chamber 11 which is further from the impacting body and a second chamber 10 which is closer to the impacting body. The first chamber 10 communicates via a connecting conduit 13 with the hydroaccumulator 17. The second chamber 10 communicates via a connecting conduit 12 with the pressure medium return conduit 18 of the hydraulic drive for the impacting body 25. A check valve 14 is arranged in the connecting conduits 12 and 13 and is actuated by a regulating device 21 connected via a control conduit 20 with a pressure medium supply conduit 19.

The connecting conduits 12 and 13 can simultaneously be blocked or opened with the aid of the check valve 14. When the check valve 14 opens, the hydraulic fluid in the first chamber 11 of the cylinder-and-piston unit is permanently under an excess pressure which corresponds to the gas pressure adjusted in the gas chamber of the hydroaccumulator 17. When the check valve 14 is in its blocking position, the hydraulic fluid accommodated in the chambers 10 and 11 of the cylinder-and-piston unit 1 is locked so that the piston 6*a* is fixed against axial displacement. In the shown embodiment the check valve 14 moves by the regulating device 21 to its blocking position when the pressure in the pressure medium supply conduit 19 decreases below a predetermined value. A switch piston provided in the check valve 14 and loaded via the control conduit 20 from the pressure medium supply conduit 19, moves by the then prevailing force of a spring to its locking position.

A first regulating cylinder 5*a* is coaxially arranged on the cylinder-and-piston unit 1 on its end facing toward the impacting body 25, and a first regulating piston 5 moves in the regulating cylinder 5*a*, together with a pusher 5*b* which axially parallel and sealingly extends in the second chamber 10. The first regulating piston 5 is permanently biased by a spring 27 to a position in which the pusher 5*b* extends in the second chamber 10 of the cylinder-and-piston unit. When the piston 6*a* during its downward movement in the cylinder-and-piston unit 1 approaches its lower end, it displaces the pusher 5*b* of the first regulating piston 5 against the force of the spring 27. Simultaneously, a piston projection 5*c* arranged on the regulating piston 5 at its side facing toward the impacting body 25, displaces a pusher 9 of the control device 2*a* to a position in which the hydraulic drive controlled by the control device stops.

The cylinder-and-piston unit 1 has at its end spaced from the impacting body 25 a second regulating cylinder 7*a* with a second regulating piston 7 sealingly displaceable therein. The second regulating piston 7 carries a pusher 7*b* which extends parallel to the piston rod 6 at a predetermined distance in the first chamber 11 of the cylinder-and-piston unit. The second regulating cylinder 7*a* is connected on that side of the second regulating piston facing away from the cylinder-and-piston unit 1, to that end of the first regulating cylinder 5*a* facing toward the second chamber 10, via a connecting conduit 8 filled by the hydraulic fluid from the hydraulic accumulator. When the piston 6*a* during its upward movement in the cylinder-and-piston unit 1 approaches the upper end of the cylinder, the pusher 7*b* displaces back the second regulating piston 7, and the hydraulic fluid displaced from the second regulating cylinder 7*a* moves via the connecting conduit 8 the first regulating piston 5 to a position in which the pusher 9 of the control device 2*a* stops the hydraulic drive.

For operation of the ramming arrangement shown in FIGS. 1–5, the arrangement in condition of completely inserted piston rod 6 for avoiding bending forces is lifted by the crane 47 by the supporting cable 22, and the piston rod 6 is fixed by the hydraulic liquid locked because of the blocking position of the check valve 14 in the first chamber 11 and in the second chamber 10 in such a manner that during lifting of the ramming arrangement, it cannot move upwardly but takes the entire weight of the ramming arrangement without noticeable displacement. When the ramming arrangement is placed with its impacting cap 26 limitedly displaceable below the impacting body 25 in the housing 3, on the upper end of the ramming pile 45, the weight of the ramming arrangement is carried by the ramming pile 45 and the piston rod 6 is correspondingly unloaded. When the pressure medium supply conduit 9 obtains a predetermined fluid pressure which is still not sufficient to lift the impacting body, the check valve 14 is moved to its open position by the regulating device 21. Thereby the ramming arrangement can remain seated without operation of the impacting body 25 against the ramming pile 45, in such a manner that it cannot be lifted by movements of the working ship 46 from the ramming pile 45.

As long as the piston 6*a* of the piston rod 6 remains under its own weight on the lower end of the cylinder-and-piston unit 1, the hydraulic drive device 2 of the impacting body 25 is switched off, inasmuch as the piston 6 retains the regulating piston 5 in depressed position and the piston projection 5*c* holds the pusher 9 of the control device 2*a* in its inwardly depressed position. When by suitably measured lifting of the supporting cable 22, the piston 6*a* moves in the cylinder-and-piston unit 1 by a sufficient distance upwardly, the thereby released pusher 5*b* of the regulating piston 5 moves under the action of the spring 27 in its position in which it projects into the second chamber 10. The thus released pusher 9 is displaced by a not shown spring or oil pressure outwardly so that the ramming operation can start. The impacting body 25 is alternately lifted and again lowered in impacting direction by the hydraulic fluid supplied via the pressure medium supply conduit 19. By the ramming impacts delivered from the impacting body 25 against the impacting hood 26, the ramming pile 45 is driven progressively into the sea bottom. The ramming arrangement supported with its inner shoulder on the impacting cap 26 moves also downwardly so that the piston 6*a* in the cylinder-and-piston unit 1 successively displaces upwardly until it drives back the pusher 7*b* of the regulating piston 7 at the upper end of the cylinder-and-piston unit and displaces the first regulating piston 5 by the respective displacement of the regulating piston 7 and the hydraulic fluid displaced via the connecting passage 8. Thereby the hydraulic drive device 2 of the impacting body 25 is stopped by the pusher 9 of the control device 2*a*.

By respective easing off of the supporting cable 22 by a distance limited by the maximum stroke length of the piston 6*a* in the cylinder-and-piston unit, for example 3 meters, the ramming operation can then proceed until the ramming pile 45 is again driven by this distance. In this manner, the ramming progress is completely controlled and measured. The ramming arrangement is compensated against eventual movements of the crane arranged on the working ship 46 because of the rough sea, wind, etc., by a greater or smaller pulling out of the piston rod 6 within the limits determined by the maximum stroke H. When exceptionally strong vertical movements take place, which exceed the available stroke length H, the impacting operation of the ramming arrangement is automatically stopped. Respectively, the impacting operation of the ramming operation can be stopped in the event of termination or unintentional break of the ramming operation by a simple easing off of the supporting cable 22, and the hydraulic pumps need only be subsequently disconnected. Instead of this, the hydraulic pumps can be first stopped and subsequently with a small feed quantity in the pressure medium supply conduit 19 a sufficient pressure for opening of the check valve 14 is obtained, and then finally the supporting cable 22 eases off and the piston 6*a*, which displaces back the control piston 5, moves the pusher 9 of the control device 2*a* to its blocking position. In both cases, the piston 6*a* in its position at the lower end of the cylinder is fixed by the hydraulic fluid locked with the aid of the check valve 14 assuming its blocking position in the cylinder-and-piston unit 1. The latter mentioned operational mode is particularly suitable for fully inwardly displacing the piston rod 6 on the deck of the working ship before laying down the ramming arrangement.

By corresponding adjustment of the gas tension in the hydroaccumulator 17, the force which counteracts the piston rod 6 during its withdrawal can be adjusted to a value suitable for the operation. In the event of inclined ramming, the reduced weight force and the increased friction can raise problems due to the changing weight components during downward sliding with inclination. This can be taken into account by a respective adjustment of the gas tension in the hydroaccumulator 17.

Figure 6:
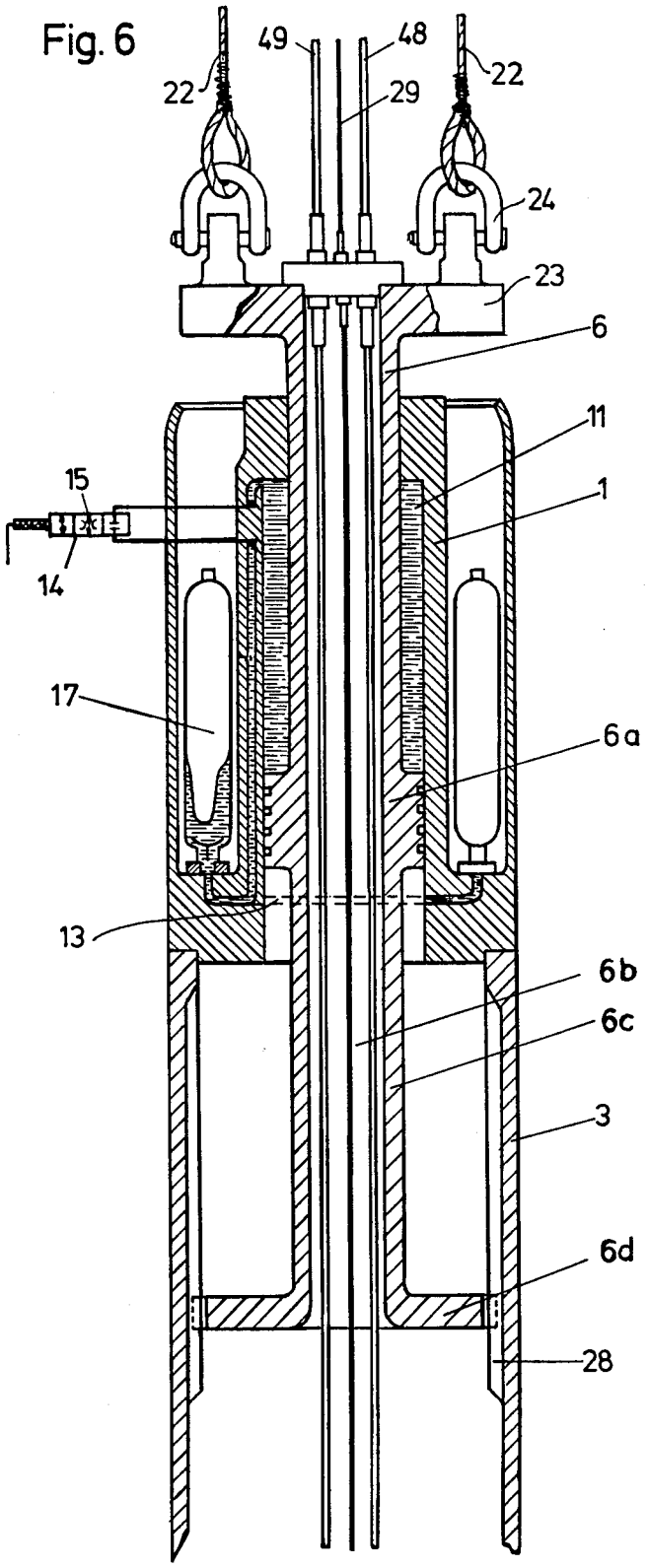
FIG. 6 is a schematic longitudinal section through the upper part of a different ramming arrangement with a simplified hydraulic cylinder-and-piston unit.
Figure 7:
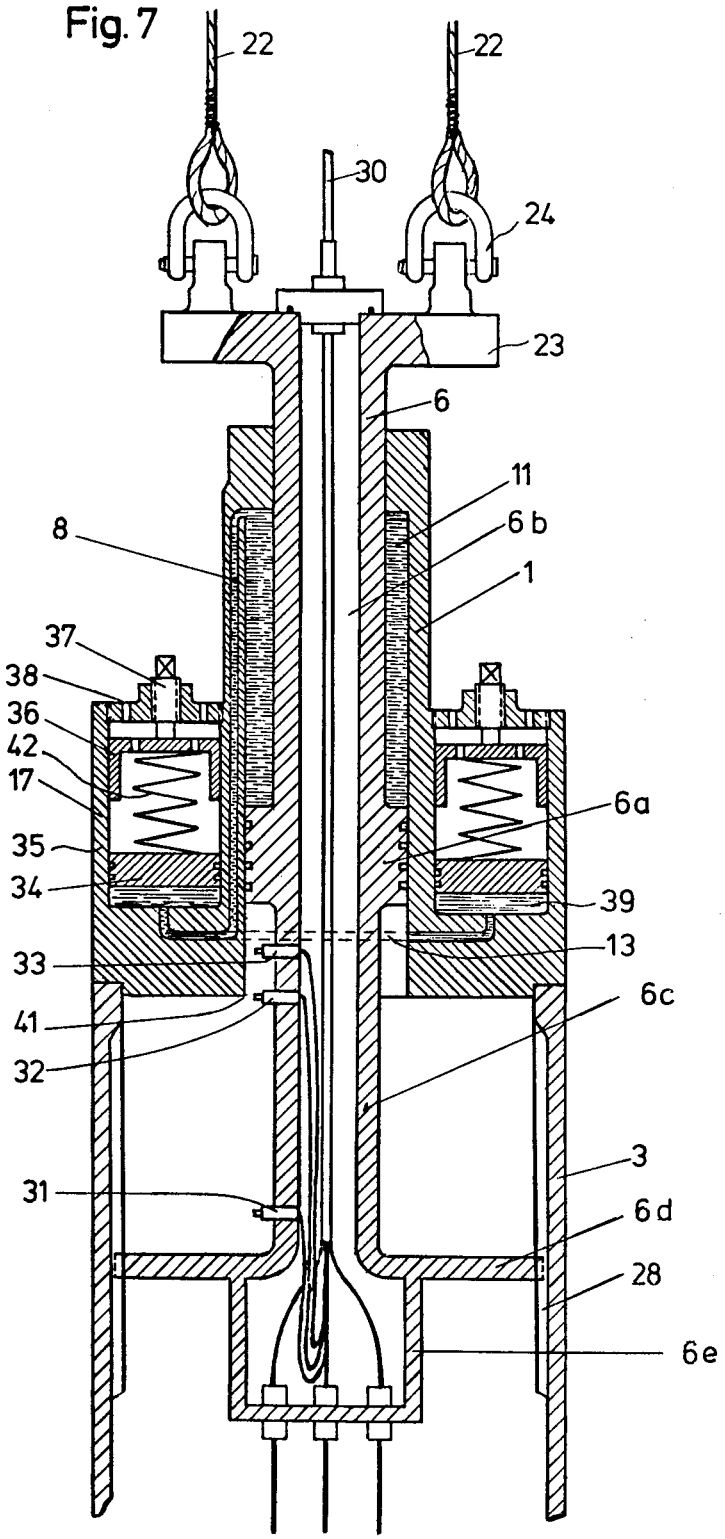
FIG. 7 is a schematic longitudinal section through the upper part of a further ramming arrangement with a single-acting hydraulic cylinder-and-piston unit.
Figure 8:
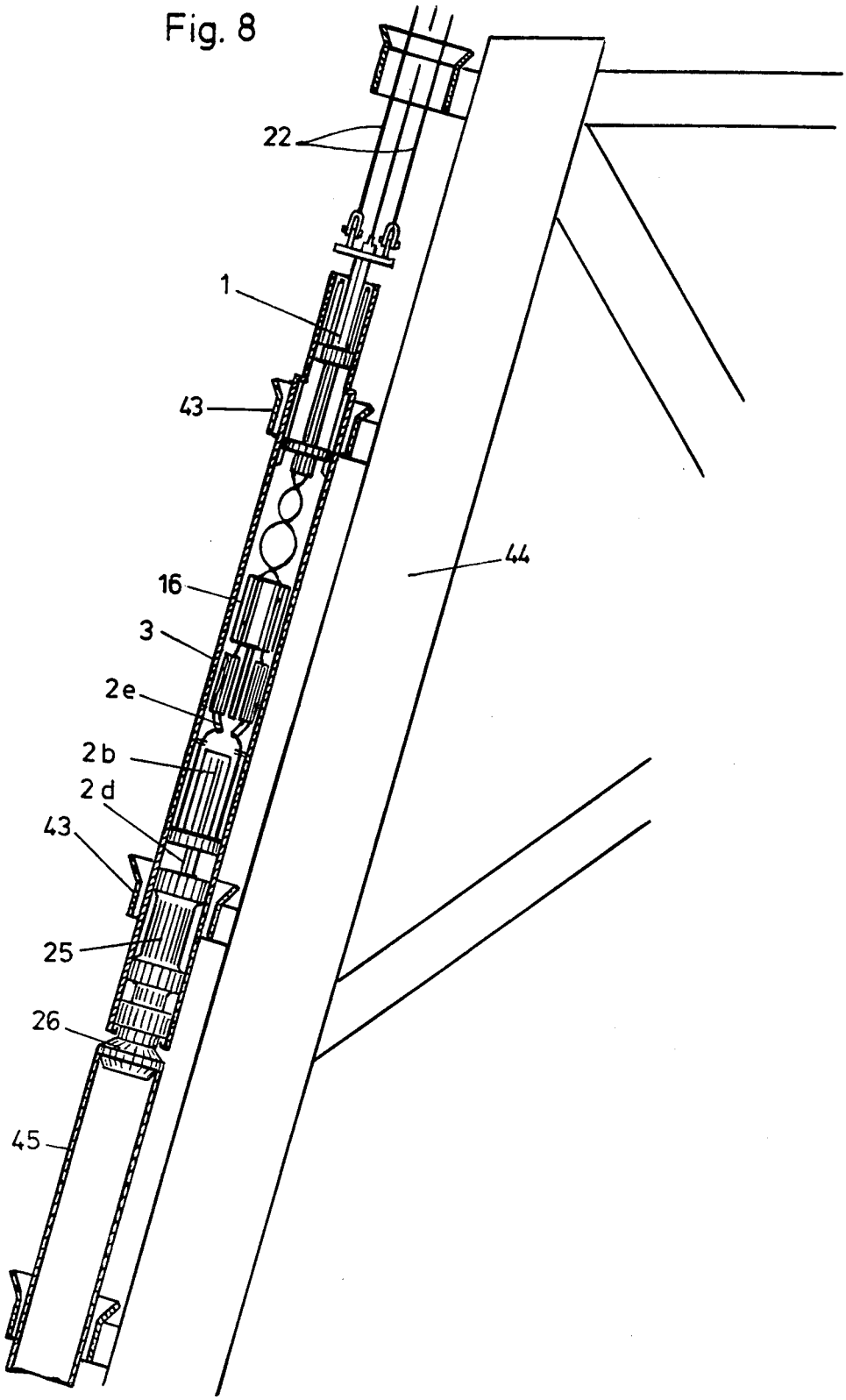
FIG. 8 is a schematic view of a ramming arrangement driving the ramming pile through its pile guide in accordance with FIGS. 6 and 7.

A slimmer ramming arrangement shown in FIGS. 6–8 has a longitudinally extending cylindrical housing 3 with an outer diameter substantially corresponding to the ramming pile 45 and can follow the latter through pile guide 43 arranged on legs of a drilling platform 44. At the lower end of the housing 3, the impacting cap 26 which is shown in FIG. 8 as seated on the ramming pile 45, displaces in a limited manner. The impacting body 25 is again coaxially displaceable in the interior of the housing 3. The impacting body 25 is driven again by the hydraulic drive device which includes a drive cylinder 2 coaxially arranged in the housing 3, a piston displaceable in the cylinder 2 and connected via a piston rod **2*d* with the impacting body 25, and a hydraulic pump 2*e* with a not shown pressure medium receiving container. In this ramming arrangement, all parts of the hydraulic drive are connected in the housing 3. In addition to the hydraulic drive, a gas-filled buoyancy container 16 is provided in the housing 3**. The hydraulic drive device can be formed as disclosed, for example, in the German Offenlegungsschrifte Nos. 2,454,521 and 2,538,642.

The hydraulic cylinder-and-piston unit 1 is arranged at the upper end of the housing and in this case is single-acting. The piston **6*a* sealingly displaceable in the cylinder of the cylinder-and-piston unit 1 is connected with the piston rod 6 projecting coaxially outwardly from the cylinder. A projection 6*c* is provided at the piston end facing toward the impacting body 25 and carries at its lower end a radially outwardly extending guiding arm 6*d* axially displaceable in guiding groove 28 on the inner wall of the housing 3. Thereby the rotation of the piston rod 6 relative to the cylinder of the cylinder-and-piston unit 1 is eliminated. The piston rod 6 is hollow and its inner chamber 6*b* serves for accommodating feeding conduits such as for example an electric cable 29, a gas supply conduit 48, a control conduit 49 or a connecting cable 30, as shown in FIG. 7. In the embodiment shown in FIG. 7, a closed switch chamber 6*e* is provided at the lower end of the projection 6*c* and communicates with the inner chamber 6*b*. The switch chamber 6*e*** can be used for accommodating suitable water-tight wiring and switching means for the feeding conduits.

The chamber 11 of the cylinder-and-piston unit 1, provided at the side of the piston **6*a* facing away from the impacting body 25, is connected via the connecting conduit 13 with several hydraulic accumulators 17 accommodated inside the housing 3 and distributed over the periphery of the cylinder. The check valve 14 provided in the connecting conduit 13 has in this case, in addition to its open position and its blocking position, a throttling position 15**.

For indicating the relative position of a reference edge 41 of the cylinder-and-piston unit 1 relative to the piston rod 6, electrical signal transmitters 31, 32, 33 acting as proximity switches are arranged on the projection of the piston rod 6 at respective locations. They serve as indicating device for the position of the piston rod 6 relative to the cylinder-and-piston unit and produce signals which are transmitted via a control conduit to a control stand of the ramming arrangement, located above water. As long as the signal transmitter indicates that the reference edge 41 is located between the signal transmitter 31 and 32, the ramming operation can proceed unobjectionably. When the reference edge 41 passes relative to the signal transmitter 31 upwardly or relative to the signal transmitter 33 downwardly, this indicates that the supporting cables 22 extending from the brackets 24 on the transverse piece 23 of the piston rod 6 to the crane 47 must displace the piston **6*a* to such a position that the reference edge 41 is again located between the signal transmitters 31 and 32. By the signal transmitters 31 and 33, the hydraulic drive device for the impacting body 25 can simultaneously be switched off for the sake of safety, so that the ramming impact first takes place when the piston 6*a* is located in the predetermined region of the cylinder of the cylinder-and-piston unit 1**.

In the embodiment shown in FIG. 7, instead of the hydroaccumulator of FIGS. 2, 3 and 6, having a gas cushion separated by a flexible diaphragm there are provided hydroaccumulators 17 operating with spring means. The accumulator has a separating piston 34 sealingly displaceable in a cylinder 35, a spring 32 biasing the separating piston 34 in direction toward a chamber 39 communicating with the hydraulic cylinder-and-piston unit 1, a supporting disk 36 cooperating with the disk 42, and a regulating screw 37 for displacement of the supporting disk 36 and a regulating disk 38 for providing the maximum stroke of the separating piston 34. By actuating the regulating screw 37 or the regulating screw 38, the force to be overcome during withdrawing of the piston rod 6 can be changed or the maximum withdrawal distance can be limited. When the separating piston 34 comes to abutment against the lower edge of the supporting disk 36 prior to reaching by the piston **6*a* of the upper end of the cylinder of the cylinder-and-piston unit 1, the practically incompressible hydraulic fluid prevents a further withdrawal of the piston rod 6. Instead of several hydroaccumulators operating with springs, it is also possible to provide an annular cylinder surrounding the cylinder-and-piston unit 1** and having an axially displaceable annular piston.

When the check valve 14 is in its throttling position 47, the initially fully inserted piston rod is slowly pulled out during raising of the ramming arrangement from its resting position by the changing direction of the pulling force on the supporting cable 22, until it is completely pulled out in vertical position and the piston **6*a* comes to metallic contact against the inner end face of the cylinder of the cylinder-and-piston unit, since the hydraulic fluid is completely displaced into the hydraulic accumulator 17. In this embodiment the weight of the ramming arrangement is carried by the direct contact of the interposed metallic faces and not by a fluid cushion provided therebetween, so that the annular face of the piston 6*a* in this case must not be dimensioned so great and the sealing must not permanently seal against the entire holding pressure. Correspondingly smaller is the annular chamber around the piston rod 6 in the cylinder-and-piston unit 1 and thereby the quantity of hydraulic fluid displaced in the hydraulic accumulator 17. The hydraulic accumulator can also be respectively smaller so as to provide for an effective economy. When laying down the suspended ramming arrangement the piston rod 16 to the contrary is automatically slowly inserted from its initially fully withdrawn position during the process of lowering to the horizontal position. The check valve 14** after raising of the ramming arrangement prior to the start of the ramming operation, is brought from the throttling position to the open position and then after the termination of the ramming operation before the lowering is again brought to the throttling position.

The construction of the ramming arrangement with the hollow piston rod 6 makes possible an advantageous protective guidance of the feeding conduits which is particularly useful for the ramming arrangements with hydraulic drives arranged in the housing. The ramming arrangement in accordance with the described embodiments of the invention can be changed in dependence upon the respective requirements in different ways, particularly so as to use the arrangements disclosed in the German Offenlegungsschriften Nos. 2,454,488; 2,454,521; 2,538,642; 2,557,704; and 2,716,701. The hydroaccumulator 17 or hydroaccumulators can be connected both with the hydraulic cylinder-and-piston unit 1, and with the drive of the impacting body 25.

It will be understood that each of the elements described above, or two or more together, may also find a useful application in other types of constructions differing from the types described above.

While the invention has been illustrated and described as embodied in a submerging ramming arrangement, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

We claim:

1. A submergible ramming arrangement adapted to be suspended on a supporting element, comprising a housing having an axis which is substantially upright in a working position, and an upper portion; an impacting body axially displaceable in said housing for delivering ramming impacts; hydraulic drive means including a first hydraulic cylinder-and-piston unit for displacing said impacting body, and a second hydraulic cylinder-and-piston unit arranged in said upper portion of said housing for adjusting displacement of the ramming device relative to the supporting element and having a cylinder with a longitudinal axis extending in direction of the displacement of said impacting body; a piston sealingly displaceable in said cylinder and subdividing the same into a first chamber farther from said impacting body and a second chamber closer to the latter, a piston rod connected with said piston and having a portion extending coaxially outwardly beyond said cylinder; holding means for mounting the arrangement on a supporting element, said holding means being provided on said on said outwardly extending portion of said piston, a hydraulic accumulator communicating with said first chamber of said second cylinder-and-piston unit and arranged for receiving excess hydraulic medium under pressure; and indicating means actuated by said piston of said second cylinder-and-piston unit within a predetermind distance from a respective end of said second cylinder-and-piston unit.

2. A submerging ramming arrangement as defined in claim 1; and further comprising regulating means actuated by said indicating means for stopping said drive means of said impacting body.

3. A submerging ramming arrangement as defined in claim 1, wherein said drive means of said impacting body has a pressure-medium receiving chamber, said second chamber of said second cylinder-and-piston unit communicating with said receiving chamber of said drive means.

4. A submergible ramming arrangement, comprising a housing having an axis which is substantially upright in a working position, and an upper portion; and impacting body axially displaceable in said housing for delivering ramming impacts; hydraulic drive means for displacing said impacting body in said housing; a hydraulic cylinder-and-piston unit arranged in said upper portion of said housing having a cylinder with longitudinal axis extending in direction of the displacement of said impacting body, a piston sealingly displaceable in said cylinder and subdividing the same into a first chamber farther from said impacting body and a second chamber closer to the latter, a piston rod connected with said piston and having a portion extending coaxially outwardly beyond said cylinder; holding means for mounting the arrangement on a supporting element, said holding means being provided on said outwardly extending portion of said piston; a hydraulic accumulator communicating with said first chamber of said cylinder-and-piston unit and arranged for receiving excess hydraulic medium under pressure; and indicating means actuated by said piston of said cylinder-and-piston unit within a predetermined distance from a respective end of said cylinder-and-piston unit;

regulating means actuated by said indicating means for stopping said drive means of said impacting body;

means for controlling said drive means of said impacting body; and pushers each arranged at a respective end of said cylinder-and-piston unit and displaceable by said piston axially outwardly to actuate said controlling means.

5. A submerging ramming arrangement as defined in claim 4, wherein said regulating means includes two regulating cylinders provided at two ends of said second cylinder-and-piston unit, a first piston sealingly displaceable in one of said regulating cylinders and provided with one of said pushers which extends with a predetermined distance into said second chamber, said first regulating piston being displaceable by said piston of said second cylinder-and-piston unit with overcoming a predetermined counterforce, to a position actuating said controlling means which controls said drive means of said impacting body for stopping same.

6. A submerging ramming arrangement as defined in claim 5, wherein said regulating means further includes a second regulating piston sealingly displaceable in the other of said regulating cylinders and provided with the other of said pushers which extends with a predetermined distance into said first chamber parallel to said piston of said second cylinder-and-piston unit, said second regulating cylinder having a side facing away from said first chamber, and said first regulating cylinder having a side facing toward said second chamber and communicating with said side of said second regulating chamber, so that hydraulic liquid displaced during depression of said second regulating piston displaces said first regulating piston to its position actuating said controlling means which controls said drive means of said impacting body for stopping same.

7. A submerging ramming arrangement as defined in claim 5; and further comprising spring means arranged to urge said first regulating piston of said regulating means to a position in which it extends into said second chamber of said second cylinder-and-piston unit.

8. A submerging ramming arrangement as defined in claim 5, wherein said controlling means has a pusher, said first regulating piston of said regulating means cooperating with said pusher of said controlling means.

9. A submerging ramming arrangement as defined in claim 3; and further comprising a first conduit communicating said first chamber of said second cylinder-and-piston unit with said hydraulic accumulator, a second conduit communicating said second chamber of said second cylinder-and-piston unit with said receiving chamber of said hydraulic drive means, and blocking means provided in at least one of said conduits.

10. A submerging ramming arrangement as defined in claim 9, wherein said blocking means includes a check valve arranged to block both said conduits.

11. A submergible ramming arrangement, comprising a housing having an axis which is substantially upright in a working position, and an upper portion; and impacting body axially displaceable in said housing for delivering ramming impacts; hydraulic drive means for displacing said impacting body in said housing and having a pressure-receiving chamber; a hydraulic cylinder-and-piston unit arranged in said upper portion of said housing having a cylinder with longitudinal axis extending in direction of the displacement of said impacting body, a piston sealingly displaceable in said cylinder and subdividing the same into a first chamber farther from said impacting body and a second chamber closer to the latter and communicating with said receiving chamber, a piston rod connected with said piston and having a portion extending coaxially outwardly beyond said cylinder; holding means for mounting the arrangement on a supporting element, said holding means being provided on said outwardly extending portion of said piston; a hydraulic medium under pressure; and indicating means actuated by said piston of said cylinder-and-piston unit within a predetermined distance from a respective end of said cylinder-and-piston unit;

a first conduit communicating said first chamber of said cylinder-and-piston unit with said hydraulic accumulator;

a second conduit communicating said second chamber of cylinder-and-piston unit with said receiving chamber of said hydraulic drive means; blocking means including a check valve provided in at least one of said conduits to block the latter, a pressure medium supply conduit for said drive means; and regulating means actuated by said indicating means for stopping said drive means of said impacting body and arranged so that in case of pressure drop in said supply conduit said regulating means moves said check valve to its position blocking said first and second conduits.

12. A submerging ramming arrangement as defined in claim 11, said drive means has a pressure medium source connected with said regulating means of said check valve, said hydraulic accumulator, said pressure medium receiving chamber and said pressure-medium source being associated with said housing.

13. A submerging ramming arrangement as defined in claim 12, wherein said hydraulic accumulator, said pressure medium receiving chamber and said pressure medium source are arranged in said housing.

14. A submerging ramming arrangement as defined in claim 12, wherein said hydraulic accumulator, said pressure medium receiving chamber and said pressure medium source are arranged on said housing.

15. A submerging ramming arrangement as defined in claim 11, wherein said pressure medium receiving chamber is arranged over water; and further comprising a pressure medium return conduit provided for said drive means of said impacting body and arranged so that said first conduit communicates via said pressure medium return conduit with said pressure medium receiving chamber, and a pressure medium source arranged over water and communicating with said regulating means of said check valve via said pressure medium supply conduit of said drive means of said impacting body.

16. A submerging ramming arrangement as defined in claim 1; and further comprising a pressure medium supply conduit, a pressure medium return conduit, and retaining means for guiding said pressure medium supply and return conduits and arranged on said outwardly extending portion of said piston rod of said second cylinder-and-piston unit.

17. A submerging ramming arrangement as defined in claim 1, wherein said indicating means includes a signal transmitter arranged to indicate a position of said piston relative to said cylinder of said second cylinder-and-piston unit.

18. A submerging ramming arrangement as defined in claim 17, wherein said signal transmitter of said indicating means is an electric signal transmitter.

19. A submerging ramming arrangement as defined in claim 17, wherein said signal transmitter of said indicating means is a pneumatic signal transmitter.

20. A submerging ramming arrangement as defined in claim 1, wherein said second hydraulic cylinder-and-piston unit is single-acting with said second chamber of said cylinder of the same being permanently open.

21. A submerging ramming arrangement as defined in claim 1; and further comprising supply lines, said piston rod of said second cylinder-and-piston unit being tubular and arranged so that said supply lines extend inside said tubular piston rod.

22. A submerging ramming arrangement as defined in claim 21, wherein said piston rod has an inner chamber, an end portion facing toward said impacting body, and a closed switch chamber arranged in said end portion of said piston rod and communicating with said inner chamber of the latter.

23. A submerging ramming arrangement as defined in claim 1; and further comprising guiding means arranged for preventing rotation of said piston rod relative to said cylinder of said second hydraulic cylinder-and-piston unit.

24. A submerging ramming arrangement as defined in claim 1, wherein said accumulator has a cylinder, a separating piston sealingly displaceable in said cylinder and subdividing the latter into two chambers one of which communicates with said second cylinder-and-piston unit, and spring means urging said separating piston in direction of reducing said one chamber.

25. A submerging ramming arrangement as defined in claim 24; and further comprising adjusting means arranged for adjusting said hydraulic accumulator.

26. A submerging ramming arrangement as defined in claim 25, where said adjusting means is arranged for adjusting a tension of said spring means of said hydraulic accumulator.

27. A submerging ramming arrangement as defined in claim 25, wherein said adjusting means is arranged for adjusting a maximum stroke of said separating piston of said hydraulic accumulator.

28. A submerging ramming arrangement as defined in claim 25, wherein said adjusting means is arranged for adjusting a tension of said spring means and a maximum stroke of said separating piston of said hydraulic accumulator.

29. A submerging ramming arrangement as defined in claim 1; and further comprising a bending-resistant casing arranged on said housing coaxial with said impacting body, said second cylinder-and-piston unit being releasably held in said casing.

* * * * *